US005188259A

United States Patent [19]

Petit

[11] Patent Number: 5,188,259

[45] Date of Patent: Feb. 23, 1993

[54] CAULKING GUN WITH BELT WORN CARTRIDGE

[76] Inventor: Jeffrey D. Petit, Rte. 10, Box 312 Thomas Rd., Canton, Ga. 30114

[21] Appl. No.: 649,498

[22] Filed: Feb. 1, 1991

[51] Int. Cl.[5] ..... B67D 5/08; B67D 5/64; B67D 5/42

[52] U.S. Cl. ..... 222/63; 222/146.5; 222/175; 222/326; 222/333; 222/390; 222/529

[58] Field of Search ..... 222/55, 63, 71, 146.5, 222/175, 608, 325-327, 333, 390, 396, 527, 529, 530, 386

[56] References Cited

U.S. PATENT DOCUMENTS

| | | | |
|---|---|---|---|
| 2,709,542 | 5/1955 | Eller et al. | 222/529 X |
| 2,748,991 | 6/1956 | McCarthy | 222/390 X |
| 3,960,294 | 6/1976 | Bernard | 222/175 X |
| 3,970,225 | 7/1976 | Jeal et al. | 222/529 |
| 3,987,869 | 10/1976 | Bowers | 222/175 X |
| 4,114,781 | 9/1978 | Doyel | 222/326 |
| 4,214,674 | 7/1980 | Jones et al. | 222/175 X |
| 4,257,540 | 3/1981 | Wegmann et al. | 222/327 X |
| 4,441,629 | 4/1984 | Mackal | 222/396 X |
| 4,496,081 | 1/1985 | Farrey | 222/529 X |
| 4,583,934 | 4/1986 | Hata et al. | 222/333 X |
| 4,653,675 | 3/1987 | Ratzky | 222/333 X |
| 4,731,058 | 3/1988 | Doan | 222/63 X |
| 4,850,513 | 7/1989 | Porter | 222/63 X |
| 4,974,752 | 12/1990 | Sirek | 222/146.5 |
| 5,046,877 | 9/1991 | Longo | 222/566 X |
| 5,105,912 | 4/1992 | Heister | 222/333 X |

FOREIGN PATENT DOCUMENTS

| | | | |
|---|---|---|---|
| 1560156 | 1/1980 | United Kingdom | 222/529 |
| 12771 | 12/1989 | World Int. Prop. O. | 222/326 |

*Primary Examiner*—Andres Kashnikow
*Assistant Examiner*—Kenneth DeRosa
*Attorney, Agent, or Firm*—Richard C. Litman

[57] ABSTRACT

A caulking device uses a long flexible tube (40) to connect a belt-worn cartridge housing (50), which accepts standard caulking cartridges, to a hand-held gun (20). The housing contains an electric motor and drive mechanism to force a piston into the cartridge. Caulking is pushed from the cartridge into the flexible tube, through the tube to the gun. The gun contains a trigger-actuated valve which allows caulking to pass into a disposable nozzle from which it is dispensed to the workpiece. A pressure sensor in the housing activates a switching circuit to maintain pressure in the tube.

1 Claim, 3 Drawing Sheets 42
52
50
54
58
56
40
120
118
116
45
60
61
10
2
14
32
22
30
26
28
24
20
40
10
8
14
16
4
6
22
114
36
34
110
32
22
40
112
30
26

CAULKING GUN WITH BELT WORN CARTRIDGE

FIELD OF THE INVENTION

The present invention relates to caulking guns.

DESCRIPTION OF THE PRIOR ART

Various devices are known in the prior art. M. B. Linton, in U.S. Pat. No. 1,833,528 shows a grease gun with a flexible hose attaching the pressure gun to a nozzle or fitting at the hose end.

S. Crewe, in U.S. Pat. No. 2,788,159 shows a caulking gun with a replaceable nozzle which screws to the gun. This invention is now less useful than it was, as caulking cartridges now come with nozzles built in.

U.S. Pat. No. 3,136,456 of W. A. Sherbondy discloses a caulking gun with a replaceable nozzle, in which the gun is powered by a compressed air tank which is worn on the back of the user. The tank feeds pressurized air to the gun through a flexible hose. The air forces the caulking in the gun out of the nozzle. The gun accepts standard caulking cartridges.

A concrete feeder/mixer is taught by G. A. Loveall, Jr. et al. in U.S. Pat. No. 3,211,337. Dry cement powder is fed through a flexible tube from a tank with a flow of air through the hose. An air compressor drives the air. Water is introduced at the nozzle, and the wet concrete mix can be sprayed onto a surface.

Davis, in U.S. Pat. No. 4,249,677, shows a caulking gun of the ordinary type with the addition of an electric motor to drive the notched piston rod forward to push out the caulking. The electric drive here does not result in any substantial change of use or advantage, beyond requiring less strength to activate the trigger.

Wegmann et al. in U.S. Pat. No. 4,257,540 discloses a hand-held grease gun with a battery-powered, fly-wheel-driven grease pump built in. The pump consists of a piston in a bore connected to a grease supply gallery. The user presses a switch to activate one pump stroke. This device is not adapted to caulking, which requires a steady flow of caulking from the caulker device.

None of the above inventions and patents, taken either singly or in combination, is seen to describe the instant invention as claimed.

The prior art does not disclose an electric caulking gun or caulker which includes a delivery tube leading from a caulking canister or cartridge to a small, hand-held gun which is easily manipulated. Nor does the prior art show such a caulker with a long, replaceable and disposable nozzle for reaching into corners. Neither does it disclose a caulker with a delivery tube of stock tubing which can be cut to length. Also, the prior art does not show a cartridge-type caulker in which the cartridge and power means are adapted to be carried on the belt rather than in the hand of the user, thus avoiding the need to lift and maneuver the mass of the caulking to the work.

Accordingly, one object of the present invention is an electric caulking gun which is easy to use with only one hand, and which exudes caulking onto a workpiece on demand, as, whenever a trigger is pulled.

Another object of the present invention is a caulker which holds the bulk of the caulking in a container on a user's belt or other convenient place, so that the mass of the caulking need not be lifted to the work.

Still another object is a caulker which uses stock tubing which can be cut to any length desired.

A further object is a caulker which accepts a variety of interchangeable nozzles adapted for a variety of caulking tasks.

These and other objects of the present invention will become readily apparent upon further review of the following specification and drawings.

SUMMARY OF THE INVENTION

The present invention is a caulking device, or caulker. It uses a long flexible tube to connect a belt-worn cartridge housing (accepting standard caulking cartridges) with a hand-held gun. The housing contains an electric motor and drive mechanism to force a piston into the cartridge. Caulking is pushed from the cartridge into the flexible tube, through the tube to the gun. The gun contains a trigger-actuated valve which allows caulking to pass into a disposable nozzle from which it is dispensed to the workpiece. A pressure sensor activates a switching circuit to maintain pressure in the tube. The pressure is controllable to vary the caulking application rate.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention, a caulker or caulking gun, is intended for caulking, gluing, and the like in cramped quarters where a standard caulking gun will not reach, or in other places. The invention also avoids the need for laborious pumping by using battery power to push the caulking out of a standard caulking cartridge.

Figures 1, 2:
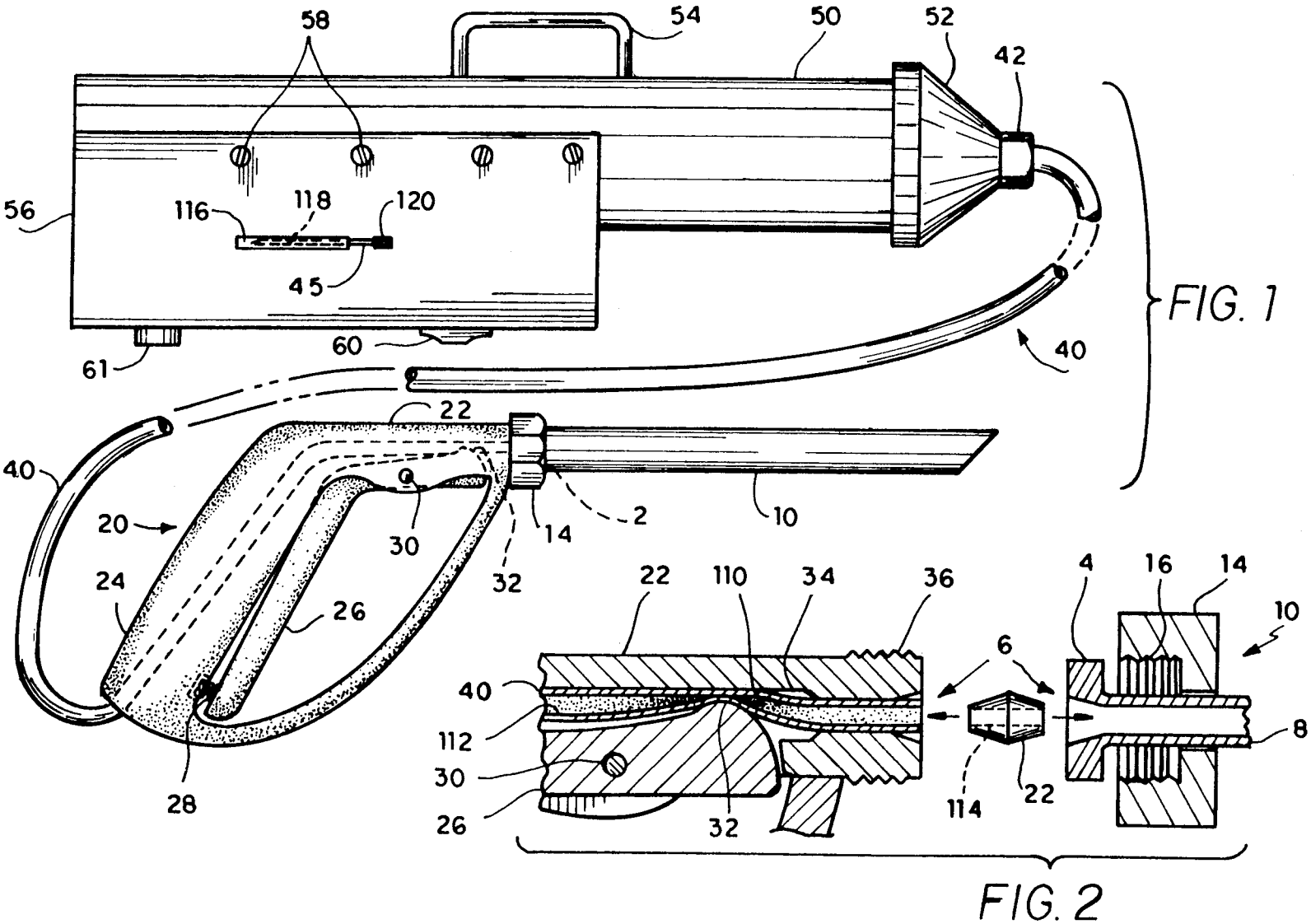
FIG. 1 is a perspective view of the invention, including the cartridge housing, flexible delivery tube, and gun.
FIG. 2 is a partially exploded cutaway partial cross section detail view of the attachment of the tube to the gun, and the caulking valve mechanism.

As seen in FIG. 1, a nozzle 10 is provided for extruding caulking onto the work. The nozzle extends from a gun 20. Caulking under pressure is delivered to the gun 20 through a flexible tube 40 from a cartridge housing 50, which holds a mechanism for forcing the caulking 110 into the tube 40.

The nozzle 10 is removably held to the gun 20 by a screw fitting 14. It may be replaced if the caulking 110 dries up inside the nozzle 10, or if it is desired to use nozzles of various lengths, tips, and diameters interchangeably.

The gun 20 includes a barrel 22 and pistol grip 24 with a trigger 26 pivoted on a hinge 30. A spring 28 holds the trigger 26 in a position away from the grip 24. The trigger 26 activates a valve or rounded end 32 which controls the flow of caulking 110 to the nozzle 10.

The valve mechanism is shown in FIG. 2. The section of the trigger 26 adjacent to the hinge 30 includes a rounded end 32 which bears on the tube 40. The tube 40 enters the butt of the pistol grip 24 and runs through a gallery which connects to a groove 34. The tube 40 is trapped between the top of the groove 34 and the rounded end 32. The spring 28 normally forces the trigger 26 away from the grip 24; pivoting around the hinge 30, the rounded end 32 forms a valve tending to close the flexible tube 40 by squeezing the interior bore 112 of the tube 40 closed. The placement of the hinge 30 close to the rounded end 32 multiplies the force of the spring 28 by leverage.

Also shown in FIG. 2 is the attachment of the nozzle 10 to the gun 20. The nozzle 10 comprises a pipe section 8 and a flange 4. The nozzle 10 is preferably of plastic which can be cut with a knife to any length or orifice angle.

An internally threaded nut 14 covers the flange 4 of the nozzle 10 to hold it against the barrel 22 of the gun 20 when the internal threads 16 of the nut 14 are screwed to the external threads 36 of the barrel 22. The flange 4 is thus clamped and held.

The muzzle or end of the barrel 22, and the orifice of the nozzle 10 adjacent the flange 4, are both enlarged by conical countersinks 6. These countersinks 6 cooperate with a metal ferrule 2 to make a tight seal between the gun 20 and nozzle 10 to forestall leakage of caulking 110. The ferrule 2 has a hollow bore 114 to pass caulking 110 through. During assembly of the gun/nozzle joint, the flexible tube 40 is passed into the countersink 6 as shown, and the ferrule 2 is forced onto it. When the flange 4 is tightened onto the barrel 22, the ferrule 2 clamps the distended sides of the tube 40 between the barrel countersink 6 and the ferrule 2.

It is also possible to attach the flexible tube 40 directly to the butt of the pistol grip 24 and feed the caulking 110 through an internal gallery of the gun 20. However, this would make cleaning more difficult.

Figure 3:
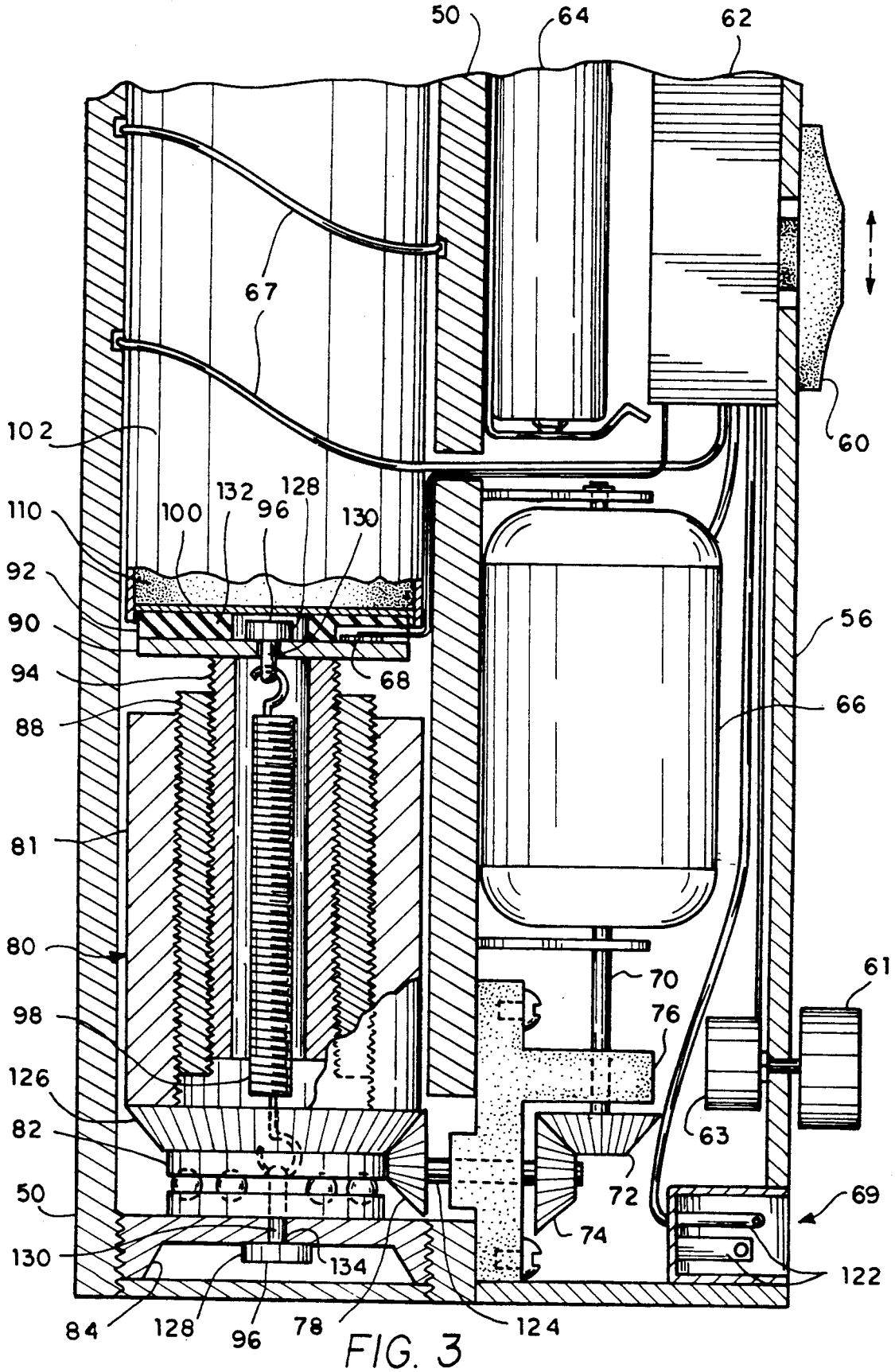
FIG. 3 is a cutaway view of the drive motor, gearing and telescopic jack which pushes caulking out of the cartridge. Electrical parts such as switch, wire and battery are also shown.
Figure 4:
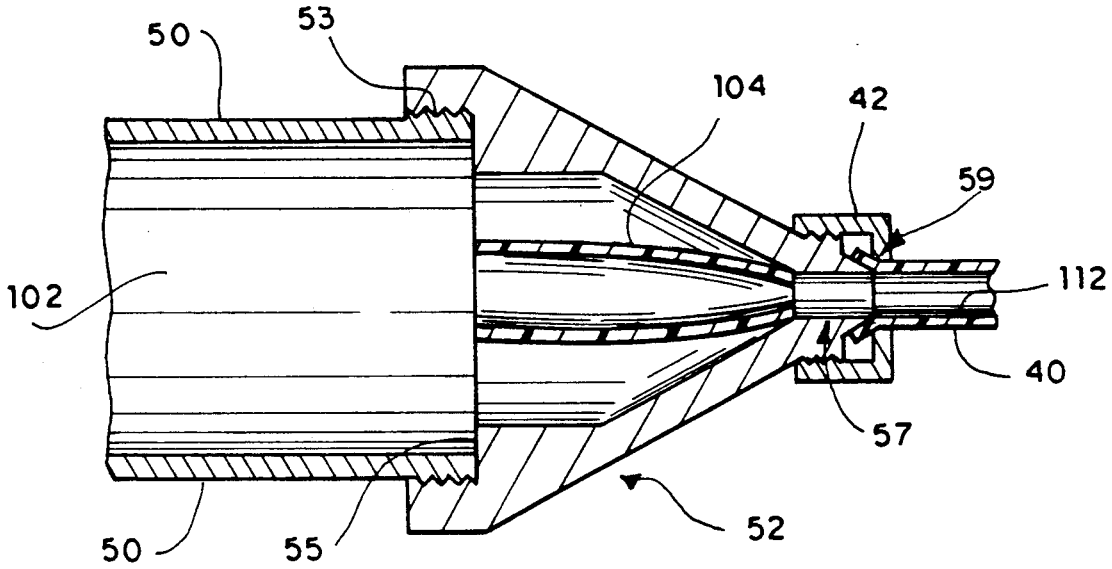
FIG. 4 is a cross sectional partial view of the housing (with a standard caulking cartridge therein), the cap, and the tube, showing the connections.

Referring again to FIG. 1, the tube 40 connects to a cap 52 which screws onto the cylindrical subhousing 50. The subhousing 50 is internally sized to contain the cylindrical caulking cartridge 102 (FIGS. 3, 4). The connection of the tube 40 to the cap 52 is made tight by a nut 42.

As shown in FIG. 4, the cap 52 screws onto the subhousing 50 by means of threads 53. A standard caulking cartridge 102 is held in the subhousing 50 by a shoulder 55 of the cap 52. (This structure allows cartridges to be loaded from this end.) The nozzle 104 of the cartridge 102, which is typically included with a proprietary cartridge, is pressed against the conical interior of the cap 52 adjacent an opening 57 which allows caulking 110 out into the tube 40. The pressure is from the jack 80 of FIG. 3, discussed below; it seals against caulking leakage.

The cylindrical opening 57 at the tip of the cap 52 includes a conical outer surface 59, over which an end of the tube 40 is stretched. The nut 42, threaded onto the cap 52, squeezes the end of the tube 40 between this surface 59 and the nut 42 to seal the tube 40.

The flexible tube 40 may be of any convenient length. It is preferably made of clear, strong plastic. The bore 112 of the tube 40 should be small enough that an excessive amount of caulking 110 is not held in the bore 112, but should be large enough that not too much friction need be overcome in forcing the caulking 110 through the tube 40.

Since the hose attachment fittings are of the type which can seal a bare, cut end of a tube which has no fittings of its own, the tube 40 may simply be cut to length from a roll of ordinary plastic tubing. Such tubing is inexpensive and readily obtained. If the caulking 110 should solidify in the tube 40, it can easily be replaced with a new one.

The subhousing 50 includes a loop 54 by which the subhousing 50 may be attached to the user's belt, or otherwise conveniently held.

A cover 56 attaches to the subhousing 50 with screws 58. The subhousing 50 and cover 56 together make up a complete housing. The surface of the cover 56 includes a scabbard 116 holding a piercing rod 45, which is used for puncturing the metal foil seal in a new caulking cartridge 102. The rod 45 may comprise a pointed steel shank 118 and a knurled handle 120. A slide switch 60 is on the surface of the housing 50, 56, preferably on the cover 56. The switch 60 controls the electrical mechanism inside the housing 50, 56 which forces the caulking 110 from the cartridge 102. A control knob 61 varies the delivery pressure of the caulking 110.

The delivery mechanism is illustrated in FIG. 3, which shows the interior of the housing 50, 56 in cutaway view; the housing 50, 56 itself is shown in cross section.

The slide switch 60 mounted on the surface of the cover 56 is part of the electrical controls which are inside a control box 62. The controls are conventional. The control box 62 includes connections to batteries 64, to an electric DC motor 66, to a pressure detector 68 at the top of the jack 80, and to a potentiometer (variable resistor) 63. The switch 60 has three positions: off, on, and heat.

In the off position, the batteries 64 are disconnected from the other electrical parts.

In the on position, the motor 66 is powered in response to a low pressure indication from the detector 68, which measures the pressure of the caulking 110 indirectly, as described below. The detector 68 is biased by the potentiometer 63, so that the user may vary the pressure by turning the knob 61. The motor 66 is cut off from the batteries 64 if the pressure rises beyond the level set by the potentiometer 63. Thus the pressure of the caulking 110 is maintained at a fixed level for even flow from the nozzle 10.

In the heat position, the batteries 64 are also connected to a thermal resistance wire 67 which coils around the inside of the cartridge space of the subhousing 50. This wire 67 prevents the caulking 110 from stiffening when the caulker is used in low temperatures.

A power plug 69 may be included to accept 110 VAC wall current through an ordinary extension cord. (The plug 69 contains the male connector elements 122, recessed within the plug 69.) The control box 62 may also contain conventional elements for transforming, rectifying, and applying the AC for powering the motor 66 and recharging the batteries 64.

The electric motor 66 turns a shaft 70 which ends in a bevel gear 72. The shaft 70 is held in a gear mounting structure 76 which bolts to the side of the subhousing 50. The mounting structure 76 holds the bevel gear 72 in meshing contact with another bevel gear 74. The gear 74 is on the same shaft 124 as bevel gear 78, which engages the bevel gear 126 on the bottom of the jack 80. The entire gear train—72, 74, 78, 126—has an overall ratio suited to drive the jack 80 slowly from the more rapid motion of the motor 66. The mounting structure 76 is preferably of low-friction plastic such as Teflon or nylon, and is molded in one piece.

The jack 80 is of telescoping construction, so as to be able to push all of the caulking 110 out of a cartridge 102 while not occupying excessive length. There are three nesting threaded cylinders: the internally threaded jack can 81, which includes the gear teeth and which contains the other parts of the jack 80; an intermediate sleeve 88 which is both externally and internally threaded; and an inner, externally-threaded sleeve 94 which is integral with a platform 90. All the threads are of the same sense (that is, all right handed or all left handed). When the jack 80 can 81 turns, the jack lengthens for the following reason.

The platform 90 is topped with a rubber mat (or other friction surface) 92. The mat 92 bears on the plastic piston 100 which plugs the bottom of a proprietary caulking cartridge 102. The friction of the cartridge 102 in the subhousing 50 prevents the platform 90 from rotating. Thus as the gears 72, 74, 78, 126 rotate the jack can 81, the platform 90 will unscrew from the jack 80. The platform's force will push caulking 110 out of the cartridge 102.

The pressure sensor 68 is disposed between the platform 90 and the rubber mat 92. The sensor 68 is a transducer, of any convenient type, which produces a voltage or resistance in response to force. The rubber mat 92 will act to spread out the force and make the output of the sensor 68 proportional to the pressure inside the caulking cartridge 102.

As the jack can 81 turns within the bore of the subhousing 50, the flat end of the jack can 81 rests on a ball thrust bearing 82, shown sectioned. The bearing 82 allows the jack 80 to rotate without friction under the force developed in forcing the caulking out. The bearing 82 in turn rests upon a plug 84 which screws into the threaded end of the subhousing 50. (The threaded fit both safely supports the force generated by the jack 80 and also allows the gear 78 to be positioned properly relative to the end of the jack can 81.)

Two rivet pins 96 retain a helical wire spring 98 which runs axially through the inner sleeve 94. Each rivet pin 96 has a flat head 128 and a pierced shank 130 which accepts one end of the spring 98. One rivet pin 96 inserts through an axial hole 132 in the platform 90, and the other through another axial hole 134 in the plug 84. The spring 98 thus tends to draw the platform 90 towards the plug 84. This is useful in returning the platform 90 to its resting position after extension.

It is to be understood that the present invention is not limited to the sole embodiment described above, but encompasses any and all embodiments within the scope of the following claims.

I claim:

1. A portable caulker comprising:

a housing to accept therein a cylindrical caulking cartridge, the housing including attachment means for attaching the housing to a belt worn by a caulker user;

electrically operated expulsion means attached to the housing for forcing caulking from the cartridge;

power means for activating the expulsion means;

a flexible tube having one end removably attached to the housing at a point where the caulking extrudes from the housing upon activation of the expulsion means, the tube being attached at said one end to accept internally the extruded caulking from said cartridge;

a gun, for controlled dispensing of caulking, attached to the other end of the flexible tube, the gun including a nozzle removably attached to the gun, for applying caulking, a valve to control passage of the caulking through the nozzle, and a trigger actuating the valve; whereby caulking forced from the cartridge by the expulsion means passes through the flexible tube and the valve to be dispensed from the nozzle when the user pulls the trigger to open the valve;

electrical pressure detection means and electrical switching means responsive to said electrical pressure detection means for activating the expulsion means to maintain a pressure level at the one end of the flexible tube attached to the housing, the expulsion means including an electric motor, a telescoping jack contained within the housing for pushing on one end of a cartridge, and means for mechanically connecting the electric motor to the telescoping jack for extending the telescoping jack upon operation of the electric motor;

the housing and the gun each including fittings to sealingly engage said one end and said other end of said flexible tube, whereby the flexible tube may be cut from a stock tubing to any desired length;

said nozzle being formed of plastic material which may be cut to any desired length and orifice angle, whereby said nozzle may be replaced with a similarly configured nozzle in the event the caulking becomes hardened within said nozzle, and may also be replaced by a differently configured nozzle depending upon different caulking requirements; and a heater for warming caulking within the housing.

* * * * *